United States Patent [19]

Machino

[11] Patent Number: 4,995,352

[45] Date of Patent: Feb. 26, 1991

[54] DYNAMIC VALVE MECHANISM OF INTERNAL COMBUSTION ENGINE

[75] Inventor: Atsumi Machino, Shizuoka, Japan

[73] Assignee: Suzuki Jidosha Kogyo Kabushiki Kaisha, Shizuoka, Japan

[21] Appl. No.: 509,335

[22] Filed: Apr. 13, 1990

[30] Foreign Application Priority Data

Apr. 28, 1989 [JP] Japan ..... 1-110720

[51] Int. Cl.[5] ..... F01L 1/18

[52] U.S. Cl. ..... 123/90.39; 123/90.41; 123/90.27

[58] Field of Search ..... 123/90.22, 90.23, 90.27, 123/90.39, 90.41, 90.44

[56] References Cited

U.S. PATENT DOCUMENTS

| | | | |
|---|---|---|---|
| 4,401,064 | 8/1983 | Nakamura et al. | 123/90.39 |
| 4,584,974 | 4/1986 | Aoyama et al. | 123/90.39 |
| 4,671,222 | 6/1987 | Gallot et al. | 123/90.27 |
| 4,714,058 | 12/1987 | Oda et al. | 123/90.23 |
| 4,773,361 | 9/1988 | Toki et al. | 123/90.23 |
| 4,796,574 | 1/1989 | Fujii et al. | 123/90.44 |

FOREIGN PATENT DOCUMENTS

| | | | |
|---|---|---|---|
| 58-79004 | 5/1983 | Japan . | |
| 2071208 | 9/1981 | United Kingdom | 123/90.39 |

*Primary Examiner*—David A. Okonsky

*Attorney, Agent, or Firm*—Flynn, Thiel, Boutell & Tanis

[57] ABSTRACT

A dynamic valve mechanism in an internal combustion engine for opening and closing a valve by swinging a rocker arm in accordance with rotation of a cam shaft. The valve mechanism includes a rocker shaft for swingably supporting the rocker arm, a positioning portion fixedly mounted on the rocker arm and projecting in the axial direction of the rocker shaft, and a thrust bearing portion mounted on the cylinder head for supporting the rocker shaft through a holding portion thereof and projecting toward the rocker arm side in order to position the rocker arm by contact with the positioning portion.

3 Claims, 3 Drawing Sheets

DYNAMIC VALVE MECHANISM OF INTERNAL COMBUSTION ENGINE

FIELD OF THE INVENTION

This invention relates to a dynamic valve mechanism of an internal combustion engine and particularly to a dynamic valve mechanism in an internal combustion engine for positioning the thrust direction of a rocker arm for opening and closing an intake/exhaust valve as a valve disc of an internal combustion engine.

BACKGROUND OF THE INVENTION

An internal combustion engine, for example, a multi-valve type internal combustion engine includes a dynamic valve mechanism which has two intake valves and two exhaust valves in one combustion chamber, the two intake valves being simultaneously opened and closed at a certain valve timing, and the two exhaust valves being simultaneously opened and closed at another valve timing.

As for the dynamic valve mechanism, there are many types of them such as a push rod type in which a push rod is used in order to increase reliability and degree of freedom for designing the configuration of a combustion chamber, a rocker arm type in which an overhead cam is used in order to increase degree of freedom for designing the configuration of the combustion chamber and to increase degree for designing the configuration of an intake hole, a swing arm system in which a swing arm is used in order to minimize the equivalent weight of a valve side of a dynamic valve system, and a direct drive system in which no rocker arm is used and a tappet is directly driven from immediately above the valve and is suitable for use in a high speed combustion engine having the highest characteristic number of vibration.

Also, as another dynamic valve mechanism, there is a mechanism having a circular conical contact surface with respect to a supporting member for supporting a rocker shaft and a rocker arm as disclosed in Japanese Utility Model Early Laid-open Publication Sho. No. 58-79004.

In the conventional dynamic valve mechanism of an internal combustion engine, as shown in FIGS. 5 and 6, a rocker arm 120 is disposed within a cam chamber 106 of a cylinder head 104 with one end thereof contacted with a valve stem end of a valve disc (not shown) and with the other end contacted with a cam portion 112*a* of a cam shaft 112. In order to swingably support the rocker arm 120, a rocker shaft 126 is thrust into a bearing portion 130 and a spring 142 of the rocker arm 120, and the rocker arm 120 is held by a holding portion 144 within the cam chamber 106. At this time, the side surface of the rocker arm 120 is urged against the side surface portion of the holding portion 144 by the energizing force of the spring 142 and the rocker arm 120 is positioned by the holding portion 144.

As a result, the conventional mechanism has a shortcoming in that because the holding portion 144 must be extended until it reaches the rocker arm 120, the thickness of the holding portion 144 in the axial direction with respect to the rocker arm 120 becomes large and, therefore, a large quantity of material is required when the holding portion 144 is manufactured and this is economically disadvantageous.

Also, it has a further shortcoming in that because of the large size of the holding portion 144, a large weight of the dynamic valve mechanism 110 of the internal combustion engine 102 is created. In addition, degree of freedom for carrying out layout of the dynamic valve mechanism 110 is limited and thus disadvantageous in actual use.

It is therefore an object of the present invention to realize a dynamic valve mechanism in an internal combustion engine in order to eliminate the above-mentioned shortcoming, which includes a rocker shaft for swingably supporting the rocker arm, a positioning portion mounted on the rocker arm and projecting in the axial direction of the rocker shaft, and a thrust bearing portion mounted on said cylinder head for supporting said rocker shaft through a holding portion thereof and projecting toward the rocker arm side in order to position the rocker arm by contact with the positioning portion. Owing to the foregoing construction, the quantity of material required at the time when the holding portion is manufactured can be minimized and this is thus economically advantageous. In addition, the dynamic valve mechanism can be made light in weight and degree of freedom for carrying out a layout of the dynamic valve mechanism can be enlarged.

In order to achieve this object, according tot he present invention, there is provided a dynamic valve mechanism in an internal combustion engine for opening and closing a valve body by swinging a rocker arm in accordance with rotation of a cam shaft, said dynamic valve mechanism in an internal combustion engine being characterized by including a rocker shaft for swingably supporting said rocker arm, a positioning portion mounted on said rocker arm and projecting in the axial direction of said rocker shaft, and a thrust bearing portion mounted on said cylinder head for supporting said rocker shaft through a holding portion thereof and projecting toward said rocker arm side in order to position said rocker arm by contact with said positioning portion.

Owing to the above-mentioned construction, at the time when the rocker arm is mounted, the rocker arm is swingably supported by the rocker shaft and this rocker shaft is carried on the cylinder head through the holding portion.

At this time, the positioning portion of the rocker arm is urged by the thrust bearing portion provided on the cylinder head, so that the rocker arm is positioned in a predetermined position.

BRIEF DESCRIPTION OF THE DRAWINGS

An embodiment of the present invention will be described in detail with reference to the drawings wherein.

DETAILED DESCRIPTION

Figure 1:
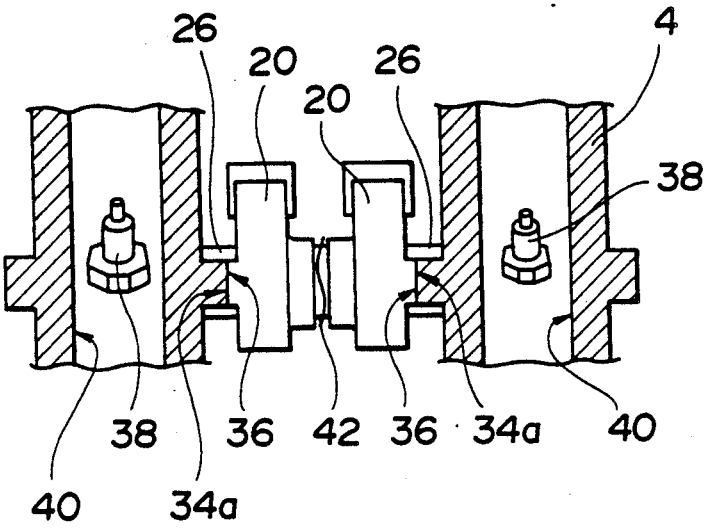
FIG. 1 is an enlarged sectional view of a portion of a dynamic valve mechanism of the present invention in an internal combustion engine.
Figure 2:
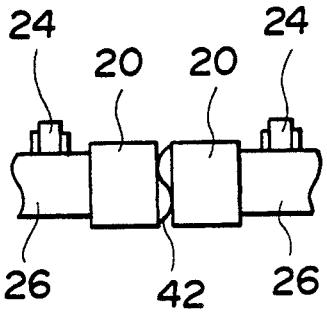
FIG. 2 is a schematic enlarged view of the dynamic valve mechanism in an internal combustion engine.
Figure 3:
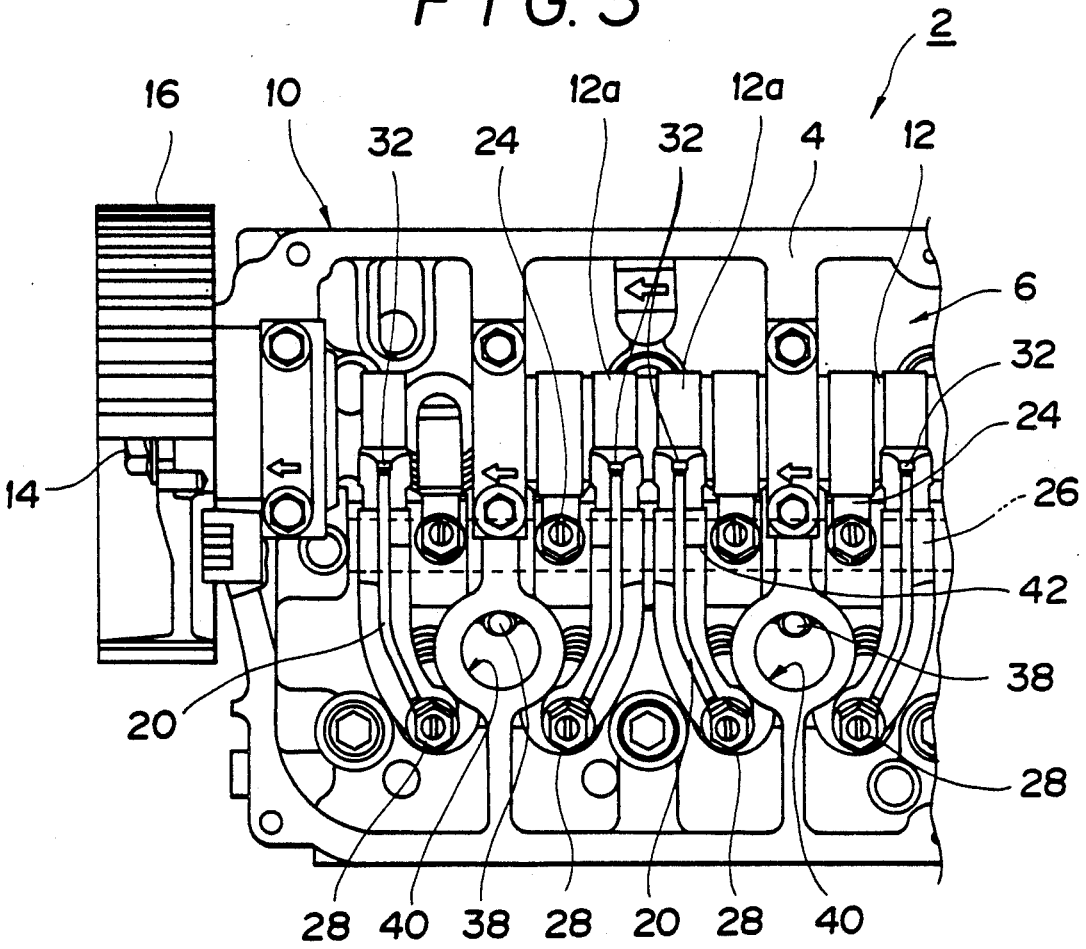
FIG. 3 is a schematic plan view of the dynamic valve mechanism in an internal combustion engine.

FIGS. 1 through 4 show an embodiment of the present invention. In FIGS. 1 through 4, numeral 2 denotes an internal combustion engine and 4 a cylinder head. The internal combustion engine 2 has a cylinder block (not shown) and the cylinder head 4. This cylinder head 4 has a cylinder head cover 8 fixed to its upper surface and adapted to form a cam chamber 6.

Within the cam chamber 6, a cam shaft 12 is disposed directed in a predetermined direction of the internal combustion engine 2. A cam shaft pulley 16 is secured to one end portion of this cam shaft 12 by a fixing bolt 14.

Also, in order to open and close a valve, for example an intake valve 18, a number of center pivot type first rocker arms 20 corresponding to the number of intake valves 18 are provided. In order to open and close an exhaust valve 22, a number of second rocker arms 24 corresponding to the number of exhaust valves 22 are provided. These first and second rocker arms 20 and 24 are axially supported at predetermined places of the rocker shaft 26.

Figure 4:
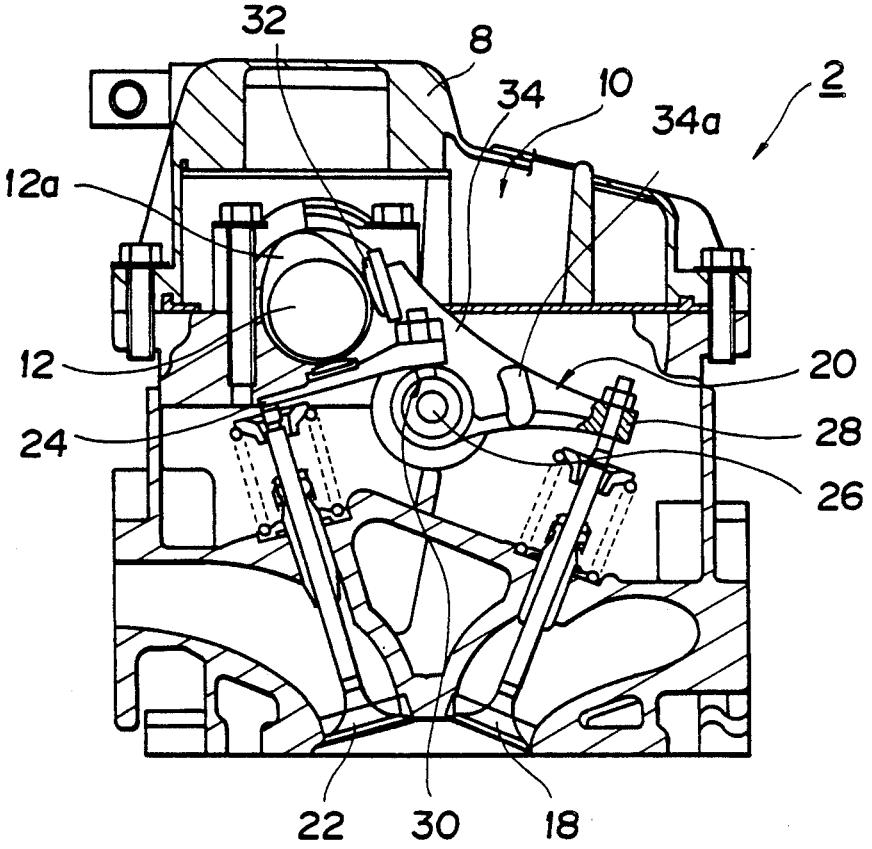
FIG. 4 is a schematic sectional right side view of the dynamic valve mechanism in an internal combustion engine.
Figure 5:
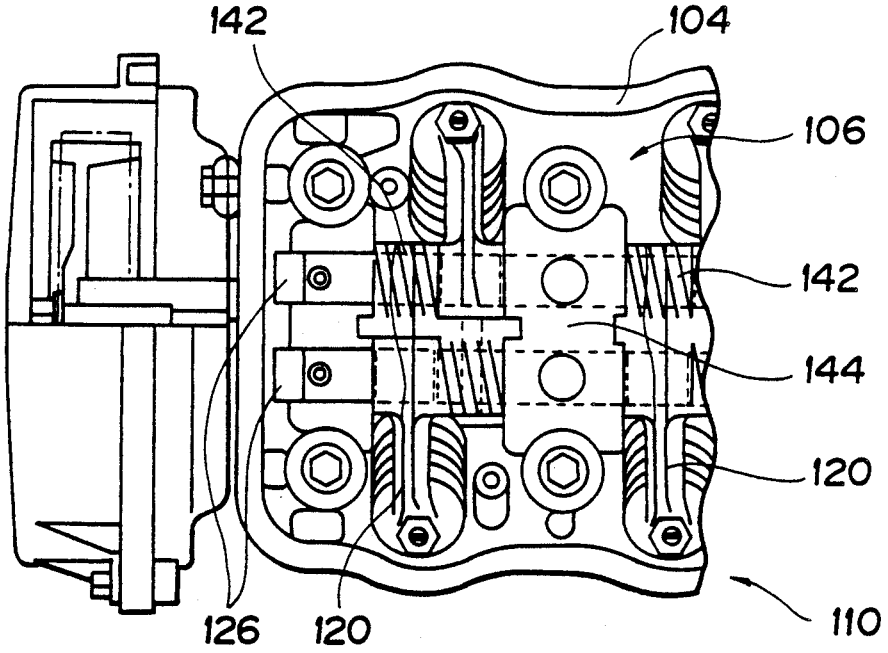
FIG. 5 PRIOR ART
FIG. 5 is a schematic plan view of a prior art dynamic valve mechanism in an internal combustion engine.
Figure 6:
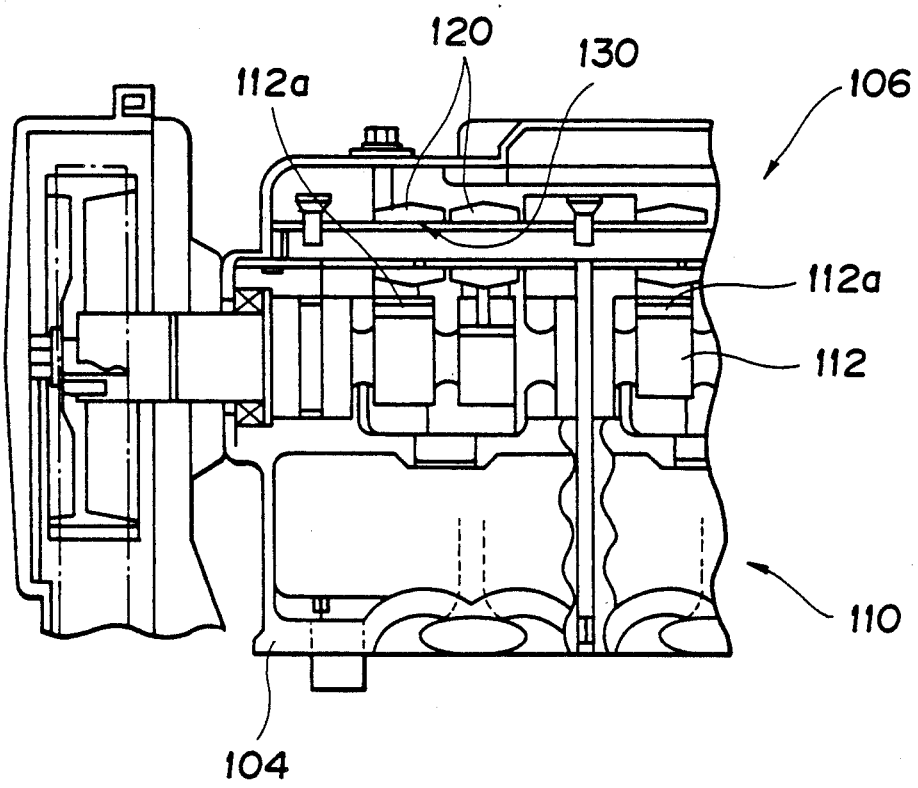
FIG. 6 PRIOR ART
FIG. 6 is a schematic sectional front view thereof.

The first rocker arms 20 will be described in detail. Each of the first rocker arms 20, as shown in FIG. 4, is integrally formed of a pushing portion 28 for pushing a valve stem end of the intake valve 18, a bearing portion 30 axially supported by the rocker shaft 26, a contact portion 32 for contacting with a cam portion 12*a* of the cam shaft 12, and a swinging arm portion 34 for interconnecting the contact portion 32, the bearing portion 30 and the pushing portion 28 respectively. The first rocker arm 20 is curved only at the pushing portion 28 side due to limitation of, for example, layout. The swinging arm portion 34 is provided with a positioning portion 34*a* projecting from its side surface portion in the axial direction of the rocker shaft 26. The rocker shaft 26 adapted to carry the first and second rocker arms 20 and 24 is carried on the cylinder head 4 through a holding portion (not shown).

Also, this cylinder head 4 is provided with a thrust bearing surface 3 projecting toward this first rocker arm 20 side in order to carry out the role for positioning the first rocker arm 20.

In other words, this thrust bearing surface 36 is FIG. 1, outwardly away from the outer side surface portion of a plug hole wall 40, in which is mounted a sparking plug 38, in order to contact and hence push against the positioning portion 34*a* provided on the swinging arm 34 of the first rocker arm 20.

The numeral 42 denotes a wave or spring washer.

The operation is described below.

The first and second rocker arms 20 and 24 are swingably supported by the rocker shaft 26 and this rocker shaft 26 is carried on the cylinder head 4 through the holding portion (not shown).

At this time, the thrust bearing portion 36 provided on the side surface of the plug hole wall 40 of the cylinder head 4 pushes against the positioning portion 34*a* provided on the swinging arm 34 of the first rocker arm 20 in order to position the first rocker arm 20.

By this, the first rocker arm 20 can be surely positioned by the thrust bearing portion 36 provided to the side surface of the plug hole 40 of the cylinder head 4, the length in the axial direction of the rocker shaft 26 of the conventional holding portion (not shown) adapted to position the first rocker arm 20 can be reduced, the quantity of material required at the time when this holding portion is manufactured can be minimized, the manufacturing cost can be lowered, and the degree of freedom for carrying out the layout of the dynamic valve mechanism 10 of the internal combustion engine 2 can be increased and thus is advantageous in actual use.

As described in the foregoing, according to the present invention, a dynamic valve mechanism in an internal combustion engine includes a rocker shaft for swingably supporting the rocker arm, a positioning portion mounted on the rocker arm and projecting in the axial direction of the rocker shaft, and a thrust bearing portion mounted on said cylinder head for supporting said rocker shaft through a holding portion thereof and projecting toward the rocker arm side in order to position the rocker arm by being contacted with the positioning portion. Owing to the foregoing construction, the quantity of material required at the time when the holding portion is manufactured can be minimized by making the holding portion small in size and the manufacturing cost can be lowered and thus made economically advantageous. In addition, by making the holding portion small in size, the degree of freedom for carrying out a layout of the dynamic valve mechanism of the internal combustion engine can be enlarged and made advantageous in practical use.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A dynamic valve mechanism in an internal combustion engine including a rocker shaft mounted on a cylinder head, a cam shaft rotatably mounted on the cylinder head and disposed in generally parallel relationship to the rocker shaft, the cam shaft having a cam thereon, a rocker arm swingably supported on the rocker shaft and having a first arm projecting radially therefrom for engagement with the cam and a second arm projecting radially therefrom for engagement with the stem of a valve projecting through the cylinder head, the improvement comprising a positioning portion fixedly and integrally joined to one arm of said rocker arm and projecting sidewardly thereof along a direction which is generally parallel with the axial direction of said rocker shaft, said positioning portion terminating in an axial free end defined by an axially facing abutment surface, and a holding portion fixed to said cylinder head and projecting axially toward said positioning portion and terminating in an axial free end which defines thereon a contact surface which is abutted against said abutment surface.

2. A mechanism according to claim 1, wherein said positioning and holding portions are each of a generally axially-projecting cantilevered configuration of small cross section and are spaced radially from said rocker shaft, and said positioning portion being fixedly and integrally joined to said second arm of said rocker arm.

3. A mechanism according to claim 2, wherein said cylinder head includes a tubular wall part defining therein a sparkplug-receiving opening, and said holding portion being fixedly joined to and projecting away from an outer surface of said tubular wall portion.

* * * * *